US006945802B2

(12) United States Patent
Hall et al.

(10) Patent No.: US 6,945,802 B2
(45) Date of Patent: Sep. 20, 2005

(54) SEAL FOR COAXIAL CABLE IN DOWNHOLE TOOLS

(75) Inventors: David R. Hall, Provo, UT (US); H. Tracy Hall, Jr., Provo, UT (US); David S. Pixton, Lehi, UT (US); Scott Dahlgren, Provo, UT (US); Joe Fox, Spanish Fork, UT (US); Cameron Sneddon, Provo, UT (US); Michael Briscoe, Lehi, UT (US)

(73) Assignee: IntelliServ, Inc., Provo, UT (US)

( * ) Notice: Subject to any disclaimer, the term of this patent is extended or adjusted under 35 U.S.C. 154(b) by 165 days.

(21) Appl. No.: 10/707,232

(22) Filed: Nov. 28, 2003

(65) Prior Publication Data

US 2005/0118848 A1 Jun. 2, 2005

(51) Int. Cl.[7] ..... H01R 4/60
(52) U.S. Cl. ..... 439/194; 439/587; 439/271
(58) Field of Search ..... 439/191, 192, 439/194, 190, 587, 271–275

(56) References Cited

U.S. PATENT DOCUMENTS

| | | | |
|---|---|---|---|
| 749,633 | A | 1/1904 | Seeley |
| 2,178,931 | A | 11/1939 | Crites et al. |
| 2,197,392 | A | 4/1940 | Hawthorn |
| 2,249,769 | A | 7/1941 | Leonardon |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,531,120 | A | 11/1950 | Feaster |
| 2,633,414 | A | 3/1953 | Boivinet |
| 2,659,773 | A | 11/1953 | Barney |
| 2,662,123 | A | 12/1953 | Koenig, Jr. |
| 2,748,358 | A | 5/1956 | Johnston |
| 2,974,303 | A | 3/1961 | Dixon |
| 2,982,360 | A | 5/1961 | Morton et al. |
| 3,079,549 | A | 2/1963 | Martin |
| 3,090,031 | A | 5/1963 | Lord |

(Continued)

FOREIGN PATENT DOCUMENTS

| | | |
|---|---|---|
| EP | 0399987 A1 | 11/1990 |
| WO | WO8801096 | 2/1988 |
| WO | WO9014497 | 11/1990 |

*Primary Examiner*—Hien Vu
(74) *Attorney, Agent, or Firm*—Cameron Sneddon; Jeffery E. Daly

(57) ABSTRACT

A seal for a coaxial cable electrical connector more specifically an internal seal for a coaxial cable connector placed within a coaxial cable and its constituent components. A coaxial cable connector is in electrical communcation with an inductive transformer and a coaxial cable. The connector is in electrical communication with the outer housing of the inductive transformer. A generally coaxial center conductor, a portion of which could be the coil in the inductive transformer, passes through the connector, is electrically insulated from the connector, and is in electrical communication with the conductive core of the coaxial cable. The electrically insulating material also doubles as a seal to safegaurd against penetration of fluid, thus protecting against shorting out of the electrical connection. The seal is a multi-component seal, which is pre-compressed to a desired pressure rating. The coaxial cable and inductive transformer are disposed within downhole tools to transmit electrical signals between downhole tools within a drill string. The internal coaxial cable connector and its attendant seal can be used in a plurality of downhole tools, such as sections of pipe in a drill string, drill collars, heavy weight drill pipe, and jars.

18 Claims, 9 Drawing Sheets

U.S. PATENT DOCUMENTS 3,170,137 A 2/1965 Brandt
3,186,222 A 6/1965 Martin
3,194,886 A 7/1965 Mason
3,209,323 A 9/1965 Grossman, Jr.
3,227,973 A 1/1966 Gray
3,253,245 A 5/1966 Brandt
3,518,608 A 6/1970 Papdopoulos
3,696,332 A 10/1972 Dickson, Jr. et al.
3,793,632 A 2/1974 Still
3,807,502 A 4/1974 Hellhecker et al.
3,879,097 A 4/1975 Oertle
3,930,220 A 12/1975 Shawhan
3,957,118 A 5/1976 Barry et al.
3,989,330 A 11/1976 Cullen et al.
4,012,092 A * 3/1977 Godbey ..... 439/191
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 Van der Graaf
4,348,672 A 9/1982 Givler
4,445,734 A 5/1984 Cunningham
4,496,203 A 1/1985 Meadows
4,537,457 A 8/1985 Davis, Jr. et al.
4,578,675 A 3/1986 MacLeod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,799,544 A * 1/1989 Curlett ..... 166/65.1
4,806,928 A 2/1989 Veneruso
4,884,071 A 11/1989 Howard
4,901,069 A 2/1990 Veneruso
4,914,433 A 4/1990 Galle
4,924,949 A 5/1990 Curlett
5,008,664 A 4/1991 More et al.
5,052,941 A 10/1991 Hernandez-Marti et al.
5,148,408 A 9/1992 Matthews
5,248,857 A 9/1993 Ollivier
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 Van Steenwyk et al.
6,196,335 B1 3/2001 Rodney
6,202,743 B1 * 3/2001 Moore ..... 166/65.1
6,209,632 B1 4/2001 Holbert et al.
6,223,826 B1 5/2001 Chau et al.
6,367,565 B1 4/2002 Hall
6,392,317 B1 * 5/2002 Hall et al. ..... 307/90
6,405,795 B2 6/2002 Holbert et al.
6,641,434 B2 11/2003 Boyle et al.
6,655,464 B2 12/2003 Chau et al.
6,670,880 B1 12/2003 Hall et al.
6,783,379 B2 * 8/2004 Kerscher et al. ..... 307/90
2002/0135179 A1 9/2002 Boyle et al.
2002/0193004 A1 12/2002 Boyle et al.
2003/0070842 A1 4/2003 Bailey et al.
2003/0213598 A1 11/2003 Hughes

* cited by examiner

SEAL FOR COAXIAL CABLE IN DOWNHOLE TOOLS

FEDERAL RESEARCH STATEMENT

This invention was made with government support under Contract No. DE-FC26-01NT41229 awarded by the U.S. Department of Energy. The government has certain rights in the invention.

BACKGROUND OF INVENTION

The present invention relates to the field of electrical connectors, particularly seals for electrical connectors for coaxial cables. The preferred electrical connectors are particularly well suited for use in difficult environments wherein it is desirable to electrically connect inside a coaxial cable without the normal means available such as BNC, RCA, SMA, SMB, and TNC type coaxial connectors. The preferred seals for electrical connectors are particularly well suited for use in difficult environments wherein it is desirable to seal inside a coaxial cable without the normal means available such as o-rings in machined grooves, metal o-rings, or a split metallic ring. One such application is in data transmission systems suitable for downhole environments, such as along a drill string used in oil and gas exploration or along the casings and other equipment used in oil and gas production.

The goal of accessing data from a drill string has been expressed for more than half a century. As exploration and drilling technology has improved, this goal has become more important in the industry for successful oil, gas, and geothermal well exploration and production. For example, to take advantage of the several advances in the design of various tools and techniques for oil and gas exploration, it would be beneficial to have real time data such as temperature, pressure, inclination, salinity, etc. Several attempts have been made to devise a successful system for accessing such drill string data.

A typical drill string is comprised of several hundred sections of downhole tools such as pipe, heavy weight drill pipe, jars, drill collars, etc. Therefore it is desirable to locate the electrical system within each downhole tool and then make electrical connections when the sections are joined together. One problem for such systems is that the downhole environment is quite harsh. The drilling mud pumped through the drill string is abrasive, slightly basic or alkaline, and typically has a high salt content. In addition, the downhole environment typically involves high pressures and temperatures. Moreover, heavy grease is typically applied at the joints between pipe sections. Consequently, the reliance on an electrical contact between joined pipe sections is typically fraught with problems.

One solution to this problem common in the drilling industry is mud pulse telemetry. Rather than using electrical connections, mud pulse telemetry transmits information in the form of pressure pulses through drilling mud circulating through the drill string and borehole. However, data rates of mud pulse telemetry are very slow compared to data rates needed to provide real-time data from downhole tools.

For example, mud pulse telemetry systems often operate at data rates less than 10 bits per second. Since drilling equipment is often rented and very expensive, even slight mistakes incur substantial expense. Part of the expense can be attributed to time-consuming operations that are required to retrieve downhole data or to verify low-resolution data transmitted to the surface by mud pulse telemetry. Often, drilling or other procedures are halted while crucial data is gathered.

Moreover, the harsh working environment of downhole tools may cause damage to data transmission elements. Furthermore, since many downhole tools are located beneath the surface of the ground, replacing or servicing data transmission tools may be costly, impractical, or impossible. Thus, robust and environmentally hardened data transmission tools are needed to transmit information between downhole tools.

Downhole data transmission systems require reliable and robust electrical connections and seals to insure that quality data signals are received at the top of the borehole.

SUMMARY OF INVENTION

The present invention is a seal for use within an internal electrical connector used within an electrical transmission line particularly a coaxial cable. The invention is useful for making reliable connections inside a coaxial cable affixed to a downhole tool for use in a data transmission system.

An object of this invention is to provide for a reliable seal for a coaxial electrical connection between an electrical transmission line and a communications element. For example a coaxial cable disposed within a downhole tool, such as a drill pipe, and an inductive transformer housed within a tool joint end of the drill pipe. Downhole information collected at the bottom of the borehole and other locations along the drill string is then sent up through the data transmission system along the drill string to the drilling rig in order to be analyzed. A data transmission system utilizing such an electrical connector with its attendant seal can perform with increased robustness and has the further advantage of being coaxial.

Data received along the drill string employing such a data transmission system will decrease the likelihood of bit errors and overall failure. In this manner, information on the subterranean conditions encountered during drilling and on the condition of the drill bit and other downhole tools may be communicated to the technicians located on the drilling platform. Furthermore, technicians on the surface may communicate directions to the drill bit and other downhole devices in response to the information received from the sensors, or in accordance with the predetermined parameters for drilling the well.

Another aspect of the invention includes a downhole tool that includes a coaxial cable, an inductive transformer, and a coaxial cable connector coupling both together. The coaxial cable connector employs an embodiment of the current invention for sealing out the fluids surrounding a downhole tool during drilling. Each component is disposed in a downhole tool for use along a drill string.

In accordance with still another aspect of the invention, the system includes a plurality of downhole tools, such as sections of pipe in a drill string. Each tool has a first and second end, with a first communication element located at the first end and a second communication element located at the second end. The system also includes a coaxial cable running between the first and second communication elements, the coaxial cable having a conductive tube and a conductive core within it. The system also includes a first and second connector for connecting the first and second communication elements respectively to the coaxial cable. Each connector utilizes an internal seal within the connector to protect the coaxial cable from downhole fluids. The first connector is in electrical communication with the first communication element, the second connector is in electrical communication with the second communication element, and the conductive tube is in electrical communication with both the first connector of the first communication element and the second connector of the second communication element.

In accordance with another aspect of the invention, the downhole tools may be sections of drill pipe, each having a central bore, and the first and second communication elements are located in a first and second recess respectively at each end of the drill pipe. The system further includes a first passage passing between the first recess and the central bore and a second passage passing between the second recess and the central bore. The first and second connectors are located in the first and second passages respectively. Preferably, each section of drill pipe has a portion with an increased wall thickness at both the box end and the pin end with a resultant smaller diameter of the central bore at the box end and pin end, and the first and second passages run through the portions with an increased wall thickness and generally parallel to the longitudinal axis of the drill pipe. The box end and pin end is also sometimes referred to as the box end tool joint and pin end tool joint.

In accordance with another aspect of the invention, the communications element may be an inductive transformer embedded in a generally cylindrical body. An outer housing and a coil comprise the inductive transformer with a terminating end of the coil in electrical communication with the outer housing. One means of creating the electrical communication between the coil and the outer housing is by welding the terminating end of the coil to the outer housing. The inductive transformer is also placed in electrical communication with the coaxial connector. For example the coaxial connector can also be welded to the outer housing thus providing reliable electrical communication between the coaxial connector and the inductive transformer.

An intermediate center conductor passes through the coaxial connector and is electrically insulated from the connector. The center conductor is placed in electrical communication with both the inductive transformer and the conductive core of the coaxial cable. The connector has a means for electrically communicating with the inner diameter of the coaxial cable, thus providing a ground connection between the inductive transformer and the coaxial cable, as will be discussed. A seal is placed within the coaxial connector and adapted to seal the annular space between the inside wall of the coaxial connector and the intermediate center conductor passing through the coaxial cable. The seal components include a bead, a compliant tube, a second packing bead, and an annular loading body. The seal components are pre-compressed to a desired pressure rating depending on the seal application.

Another aspect of the invention is to provide reliable electrical connection between data transmission system tools for a power and carrier signal that is resistant to the flow of drilling fluid, drill string vibrations, and electronic noise associated with drilling oil, gas, and geothermal wells.

In accordance with another aspect of the invention, the system includes a coaxial cable with a conductive tube and core within it, a coaxial connector is placed within the conductive tube. The ground connection is made between the coil in the inductive transformer and the coaxial connector by welding a terminating end of the coil to the connector. The intermediate center conductor is electrically insulated as it passes through the connector and is placed in electrical contact with the conductive core of the coaxial cable. The means for electrically insulating the intermediate center conductor as it passes through the connector also serves as a seal between the coaxial connector and the center conductor.

In accordance with the invention an electrical signal is passed through the conductive tube of the coaxial cable, through the intermediate center conductor within the coaxial connector, and through the coil in the inductive transformer. The grounded return path passes through the terminating end of the coil in the inductive transformer, through the coaxial connector, and to the conductive tube of the coaxial cable.

In accordance with another aspect of the invention, the method of assembly of these tools includes welding a coaxial connector to the outer housing of an inductive transformer, passing an intermediate center conductor that is a portion of the inductive transformer coil through the coaxial connector and the seal components placed within the coaxial connector, welding a terminating portion of the inductive transformer coil to the outer housing, compressing the seal components within the coaxial connector, and finally pushing the coaxial connector into a coaxial cable end thereby making electrical contact with both the conductive tube and core of the coaxial cable.

In accordance with another aspect of the invention, the tools are sections of drill pipe, drill collars, jars, and similar tools that would be typically found in a drill string. A plurality of communications elements and electrical transmission tools are disposed within each tool along a drill string. The communications elements and electrical transmission tools are in electrical communication via internal coaxial cable connectors It should be noted that, as used herein, the term "downhole" is intended to have a relatively broad meaning, including such environments as drilling in oil and gas, gas and geothermal exploration, the systems of casings and other equipment used in oil, gas and geothermal production.

It should also be noted that the term "transmission" as used in connection with the phrase data transmission or the like, is intended to have a relatively broad meaning, referring to the passage of signals in at least one direction from one point to another.

BRIEF DESCRIPTION OF DRAWINGS

The present invention, together with attendant objects and advantages, will be best understood with reference to the detailed description below in connection with the attached drawings.

DETAILED DESCRIPTION

Figure 1:
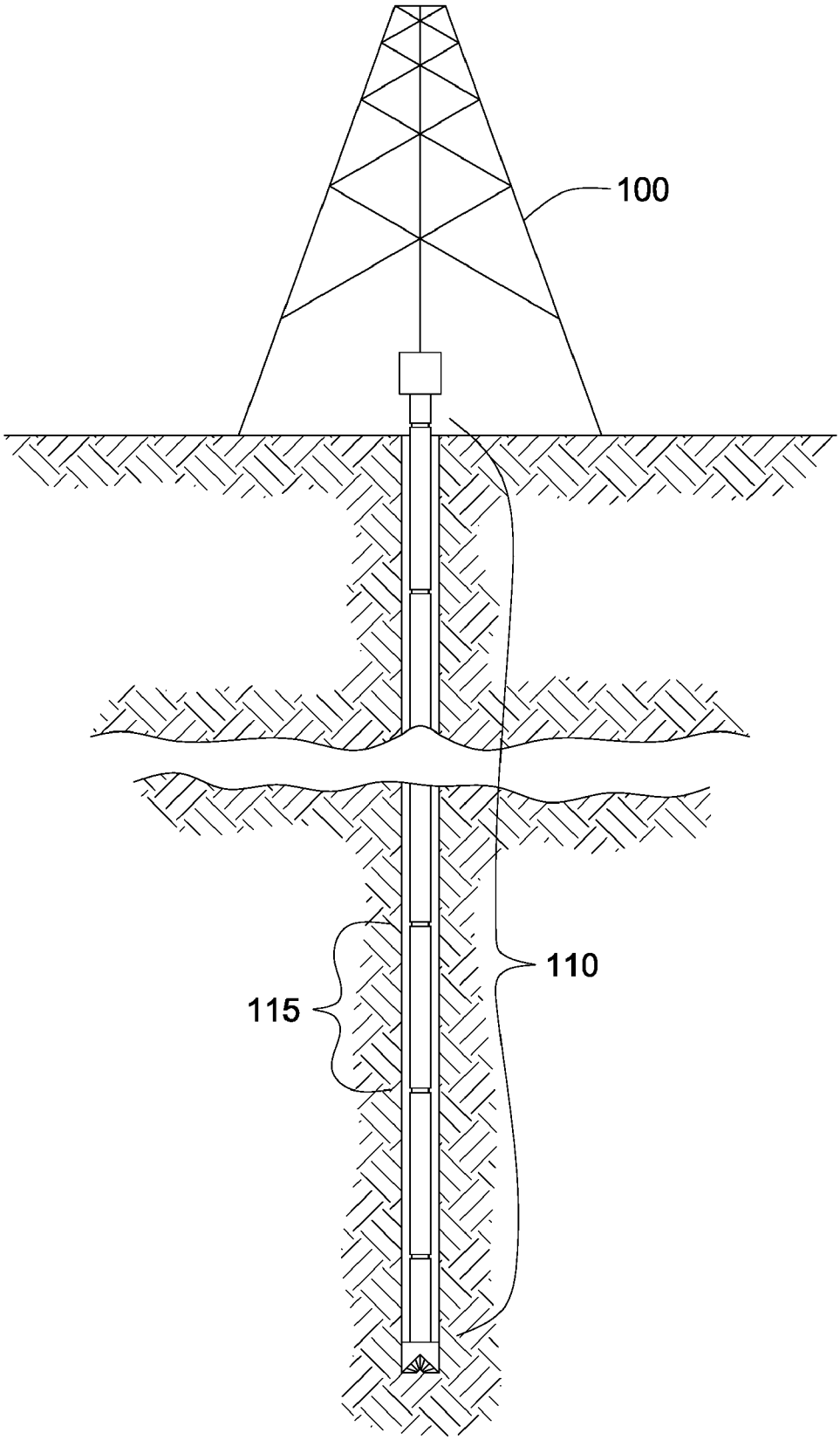
FIG. 1 is a schematic representation of a drill string in a borehole as used on a drilling rig including downhole tools.

Referring to the drawings, FIG. 1 is a schematic representation of a drill string 110 in a borehole as used on a drilling rig 100 including drilling tools 115. Some examples of drilling tools are drill collars, jars, heavy weight drill pipe, drill bits, and of course drill pipe.

Figure 2:
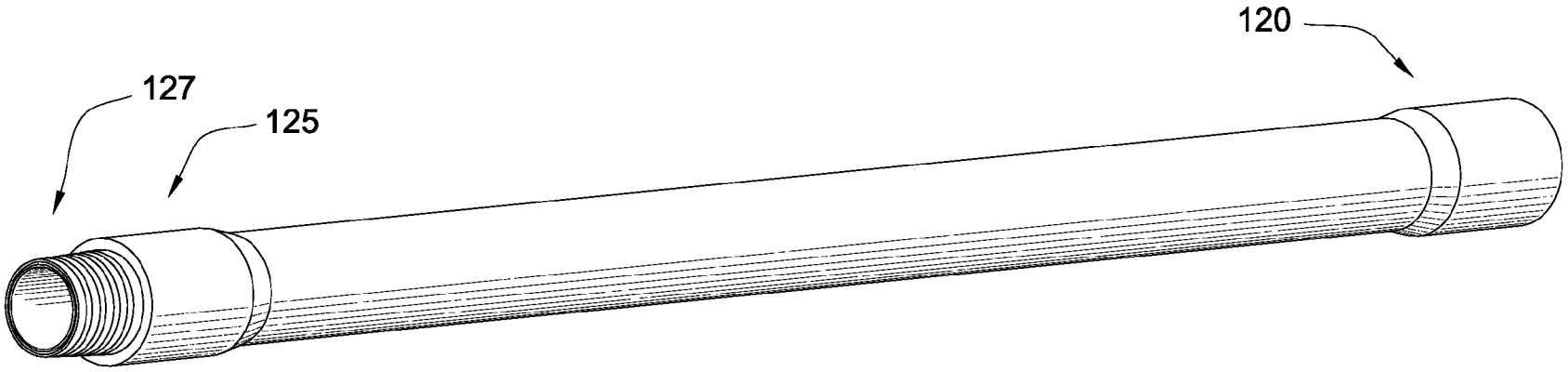
FIG. 2 is a drill pipe, a typical example of a downhole tool including tool joint sections.

FIG. 2 shows one example of a drilling tool, a drill pipe 115 including a box end tool joint 120, pin end tool joint 125, and the pin nose 127 of pin end tool joint 125. Tool joints are attached to the tool and provide threads or other devices for attaching the tools together, and to allow a high torque to be applied to resist the forces present when making up a drill string or during drilling. Between the pin end 125 and box end 120 is the body of the drill pipe section. A typical length of the body is between 30 and 90 feet. Drill strings in oil and gas production can extend as long as 20,000 feet, which means that as many as 700 sections of drill pipe and downhole tools can be used in the drill string.

Figure 3:
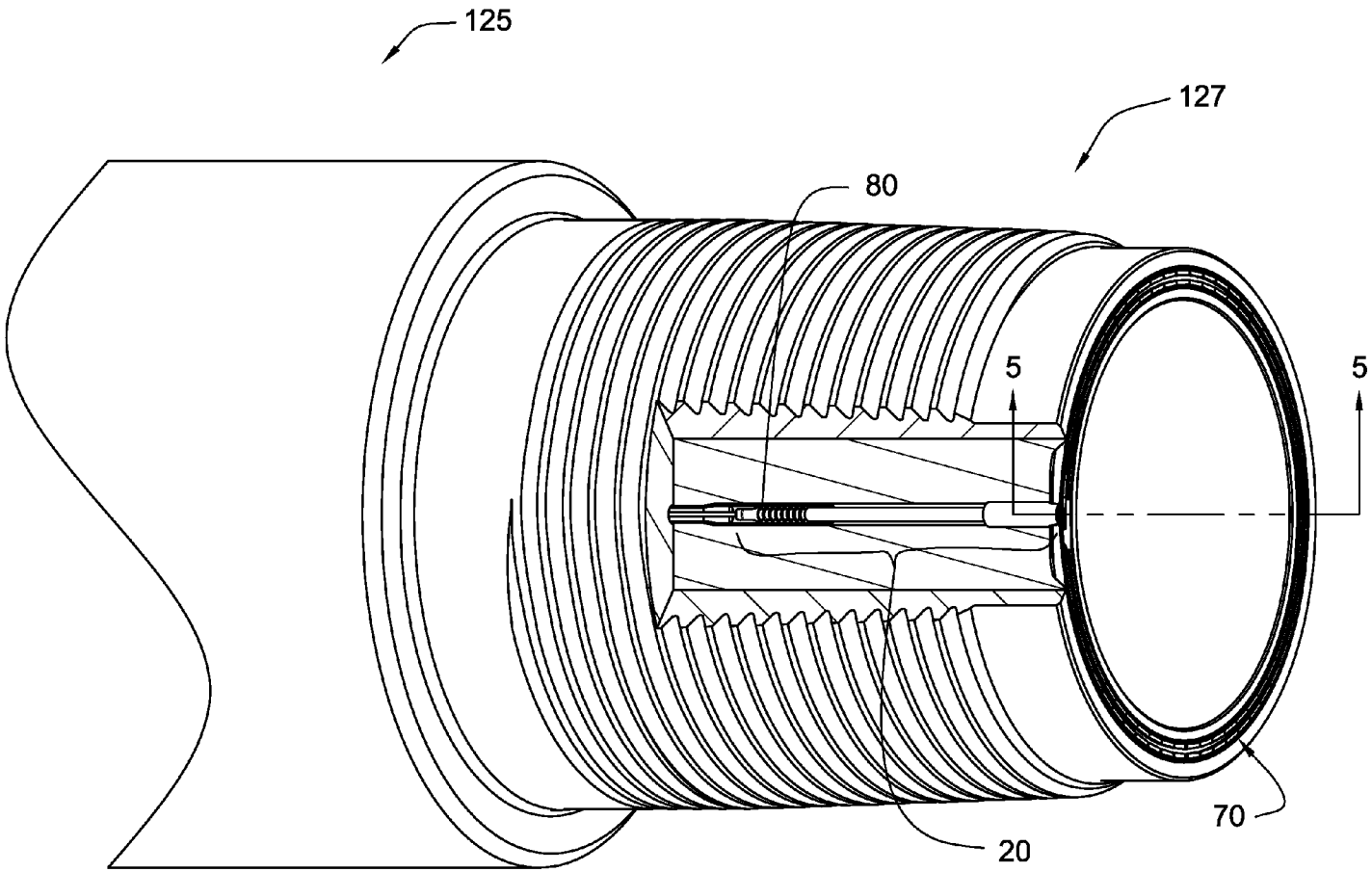
FIG. 3 is a close up of a partial cross sectional view of the pin nose of the pin end tool joint of FIG. 2.

A close up of pin end tool joint 125 is shown in FIG. 3. A coaxial cable connector 20 is shown in the partial cross section of the pin nose 127 as it is disposed in the pin nose of the pin end tool joint 125. A coaxial cable 80 is disposed within the drill pipe running along the longitudinal axis of the drill pipe 115. The coaxial cable includes a conductive tube and a conductive core within it (not shown). A communications element such as an inductive transformer 70 is disposed in the pin nose 127 of pipe 115 the detail of which will be shown in the remaining figures. A close up (not shown) of the box end 120 of pipe 115 would depict a similar arrangement of the inductive transformer, coaxial cable, and coaxial cable connector.

In a preferred embodiment the drill pipe will include tool joints as depicted in FIG. 2 however, a drill pipe without a tool joint can also be modified to house the coaxial cable and inductive transformer; thus tool joints are not necessary for the invention. The coaxial cable and inductive transformer could be disposed in other downhole tools such drill collars, jars, and similar tools that would be typically found in a drill string. Additionally the coaxial cable could be disposed within other downhole tools used in oil and gas or geothermal exploration through which it would be advantageous to transmit an electrical signal and thus necessitate an electrical connector.

The conductive tube is preferably made of metal, more preferably a strong metal, most preferably steel. By "strong metal" it is meant that the metal is relatively resistant to deformation in its normal use state. The metal is preferably stainless steel, most preferably 316 or 316L stainless steel. A preferred supplier of stainless steel is Plymouth Tube, Salisbury, Md.

In an alternative embodiment, the conductive tube may be insulated from the pipe in order to prevent possible galvanic corrosion. At present, the preferred material with which to insulate the conductive tube is PEEK®.

Figure 4:
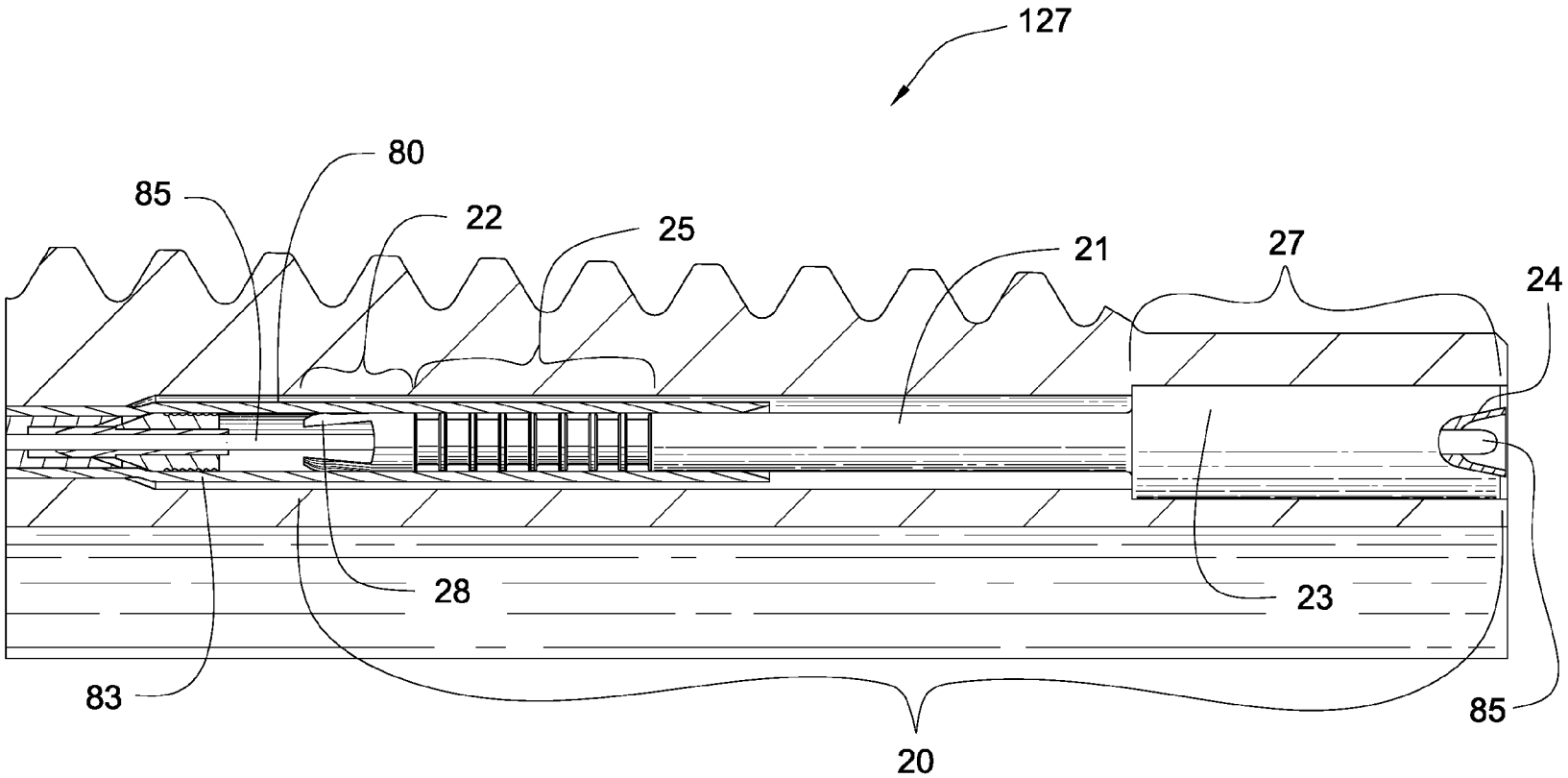
FIG. 4 is a cross sectional view of the pin nose of the pin end tool joint along the lines 55 of FIG. 3.

With reference now to FIG. 4 of the present invention which is a cross sectional view of the pin nose 127 of pin end tool joint 125 along lines 55 in FIG. 3, the placement of the coaxial cable connector will be described. The pin nose 127 includes a bore within the pin nose annular wall for placing the coaxial cable 80. The coaxial cable connector 20 is placed in the bore with the second end 22 placed inside the conductive tube 83 of coaxial cable 80. The second end 22 is in electrical communication with the conductive tube 83 of the coaxial cable. One means of electrical communication is to use bulbous pliant tabs 28. Electrical communication is insured by constructing the bulbous portion of the pliant tabs with a larger diameter than the inside diameter of the conductive tube 83 of coaxial cable 80. Upon insertion the bulbous pliant tabs 28 of the second end 22 deflect with the resultant spring force of the tabs causing them to contact the inside diameter of the conductive tube 83 and thus provide electrical communication between the coaxial cable connector and the coaxial cable.

Turning again to FIG. 4 we see the tube 21 of coaxial cable connector 20 with a first end 27 and second end 22. An embankment of grooves 25 along the tube 21 can employ a seal mechanism, such as an o-ring. The seal mechanism is used to shield the internal diameter of the coaxial cable from drilling fluid and other contaminants. A head 23 is located on the first end 27 and positioned nearest the face of the pin nose 127. An inductive transformer is placed in a groove formed in the pin nose 127. The head 23 is in electrical communication with the inductive transformer. One means of electrical communication is by placing the inductive transformer in a saddle 24 in the head 23 and welding the two together, the detail of which will be depicted and described in the drawings below.

A generally coaxial center conductor 85 passes through the coaxial cable connector. The center conductor is electrically insulated (not shown) from the head 23, tube 21, and second end 22 as it passes through the coaxial cable connector. The means of electrically insulating the center conductor as it passes through the coaxial cable connector can also be employed to seal between the same, thus safeguarding the inner portion of the coaxial connector form drilling fluid and other contaminants. The inductive transformer is in electrical communication (not shown) with the center conductor 85 as well as the conductive core (not shown) of the coaxial cable 80. The arrangement and features of the coaxial cable connector as described above renders the electrical connection between both the coaxial cable and the inductive transformer a coaxial arrangement.

Figure 5:
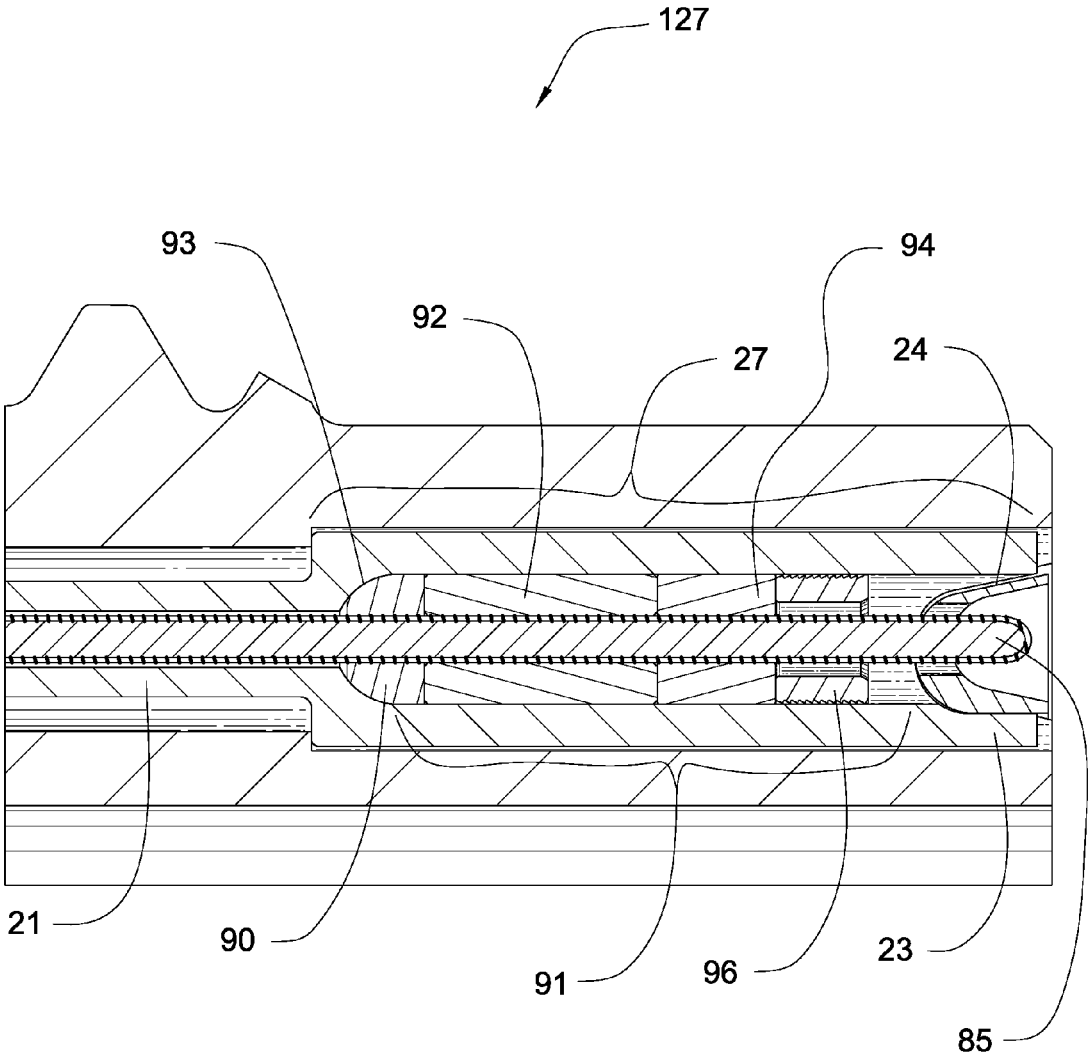
FIG. 5 is a perspective close up view of the seal components in a cross section of the coaxial cable connector as found in the pin nose of the pin end tool joint of FIG. 4.

Beginning with FIG. 5, we"ll now focus our discussion on the seal for the coaxial cable connector. FIG. 5 is a close up view of the seal as found in a depicted cross section of the coaxial cable connector of FIG. 4. The coaxial cable connector includes a tube 21 with a first end 27. A head 23 is on the first end 27 which includes a saddle 24. The saddle 24 is shaped to conform to the outer housing of the inductive transformer. An upset portion 91 of the tube 21 is shown within the head 27. A first bead 90 is disposed on the bottom of the upset 93. A compliant tube 92 lies adjacent the bead with a second packing bead 94 adjacent the compliant tube 92. To pre-compress the seal and retain the seal components within the upset portion 23, an annular loading body 96 is disposed adjacent the second packing body 94. A generally coaxial center conductor 85 passes through the seal components. The coaxial center conductor is thereby insulated from the coaxial cable connector and a seal forms in the annular space between the upset portion 23 and the coaxial center conductor 85.

The coaxial cable connector is preferably constructed of a hard material that is electrically conductive such as certain metals. The metals could be steel, titanium, chrome, nickel, aluminum, iron, copper, tin, and lead. The various types of steel employed could be viscount 44, D2, stainless steel, tool steel, and 4100 series steels. Viscount 44 however is the most preferable material out of which to construct the coaxial cable connector.

Figure 6:
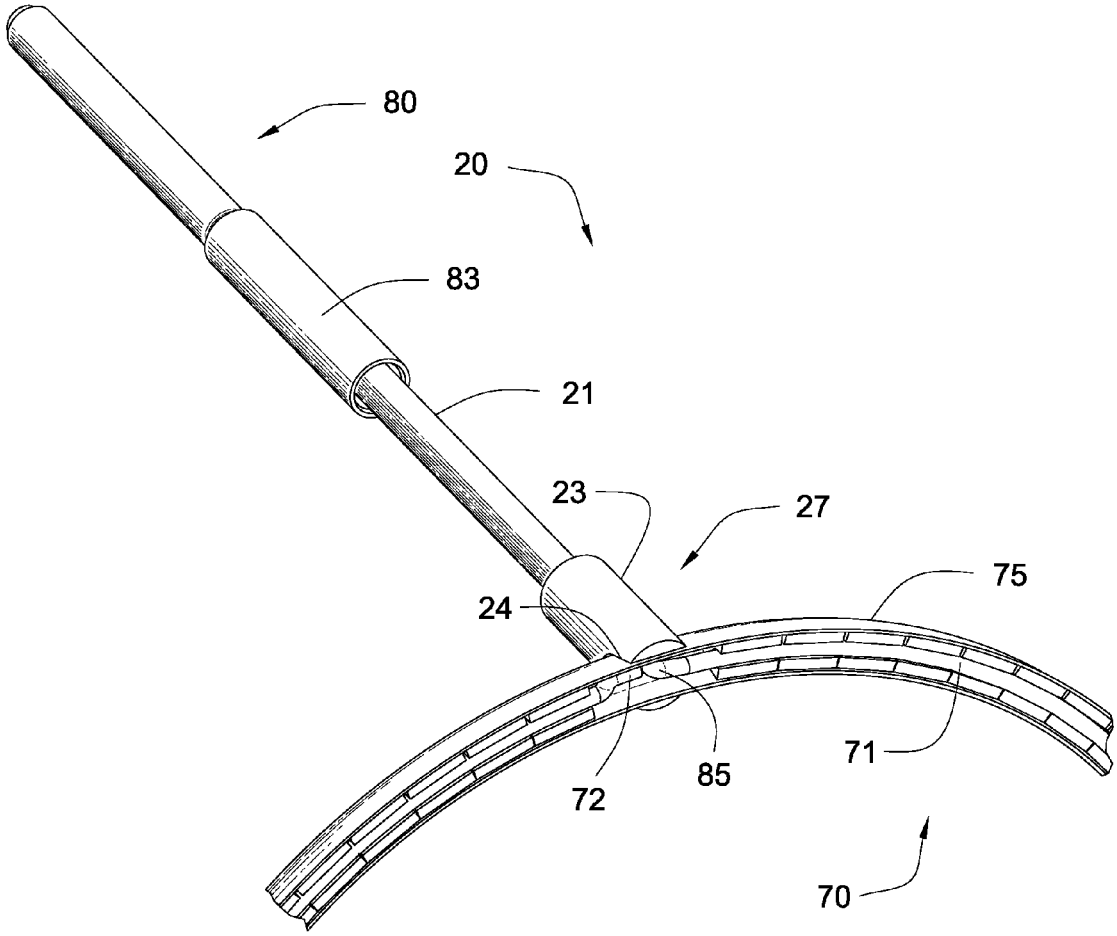
FIG. 6 is a perspective view showing the coaxial cable connector with an inductive transformer and a coaxial cable.

FIG. 6 shows how the coaxial cable and the inductive transformer are coupled using the coaxial cable connector. For the purpose of clarity in how the components are assembled when in operation, the downhole tool, into which each component is placed, is not shown.

FIG. 6 is a perspective view of the inductive transformer, coaxial cable connector, and the coaxial cable. An inductive transformer 70 including a coil 71 and outer housing 75 is placed in the saddle 24 of the head 23. The most preferable saddle is shaped to conform to the outer housing contour thus providing significant surface area contact. A terminal end 72 of the coil 71 is in electrical communication with the outer housing 75, welding the two parts together being the preferred method of creating the electrical communication.

A portion of the coil 71 becomes the coaxial center conductor 85 that passes through the head 23, tube 21 and out the second end (not shown) of the coaxial cable connector. The coaxial center conductor is then placed in electrical communication with the conductive core (not shown) of the coaxial cable 80. The electrical communication is made as the second end of the tube 21 of coaxial cable connector 20 is inserted into the conductive tube 83 of coaxial cable 80. The head 23 could be diametrically larger than the tube 21 and the conductive tube 83 of coaxial cable 80. This would stop the coaxial connector 21 from being inserted into the coaxial cable beyond a certain point. The shape of saddle 24 is clearly shown to conform to the contour of the outer housing 75 of the inductive transformer 70. Welding the saddle 24 to the outer housing 75 gives the added benefit of essentially creating a one-piece part. This is easier for handling and allows the assembly of the inductive transformer into a drilling tool and the insertion of the coaxial cable connector into a coaxial cable in the same drilling tool, to be accomplished in one operation.

Figure 7:
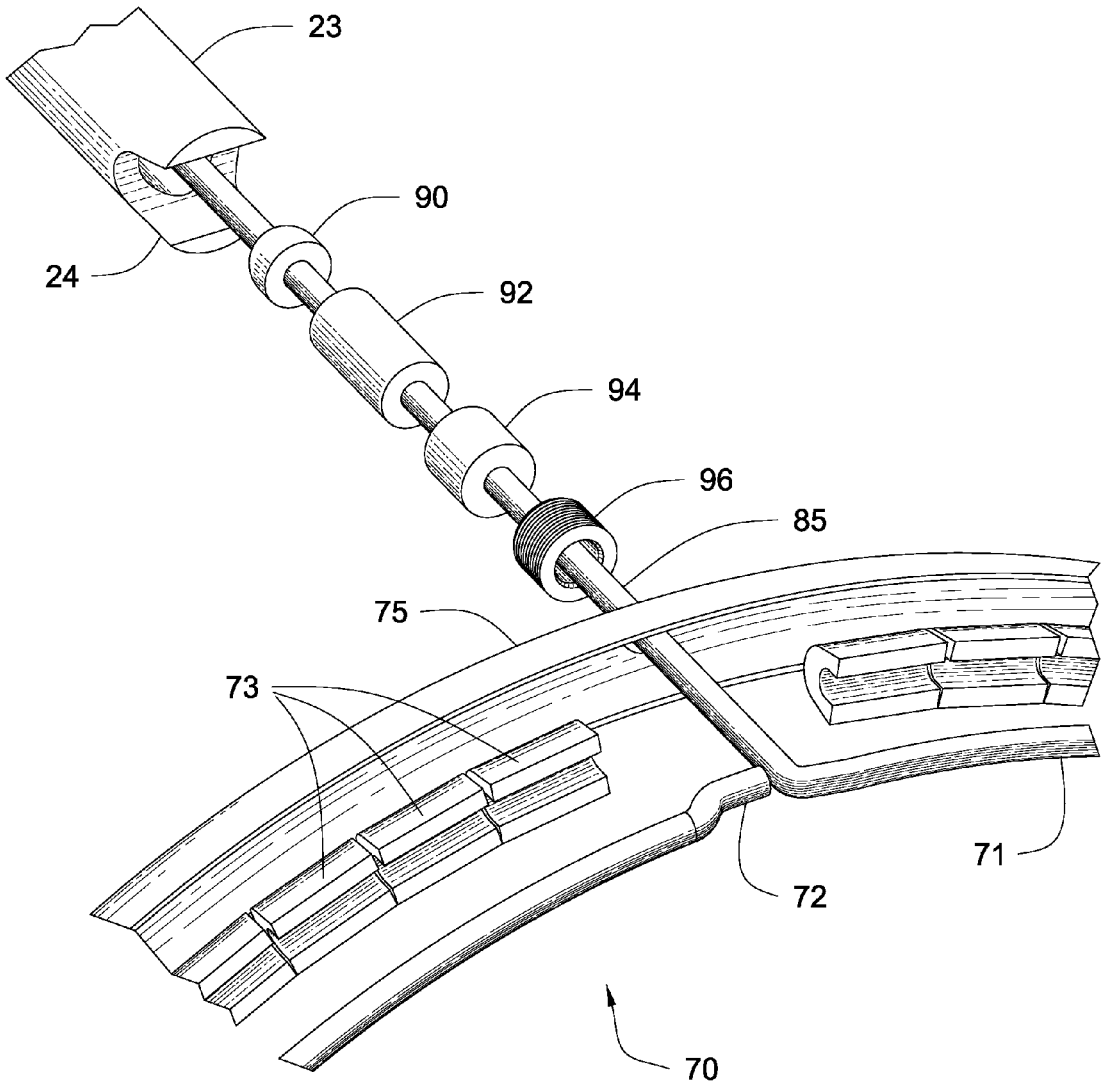
FIG. 7 is an exploded view of the seal components of FIG. 5.

FIG. 7 depicts and exploded view of the sealing components of the present invention as shown in FIG. 6. An inductive transformer 70 comprises a coil 71, an outer housing 75, and magnetically conductive, electrically insulating elements 73. A terminal end 72 of the coil 71 is in electrical communication with the outer housing 75, welding the two parts together being the preferred method of creating the electrical communication.

A portion of the coil 71 becomes the generally coaxial center conductor 85 that passes through the sealing components, the head 23 including the upset portion (not shown) and saddle 24, tube 21(not shown) and out the second end (not shown) of the coaxial cable connector. The coaxial center conductor is then placed in electrical communication with the conductive core of the coaxial cable (not shown). The sealing components include the annular loading body 96, the second packing bead 94, the compliant tube 92, and the first bead 90.

During assembly, the second loading body and the compliant tube are pre-compressed between the annular loading body and the first bead to a desired pressure relevant to the pressurized environment the coaxial cable will be subjected to while downhole. For example, if the desired pressure rating for the coaxial cable connector is 25,000 psi, the sealing components would be pre-compressed to at least 25,000 psi. The annular loading body provides the means for compressing the second packing bead and compliant tube when the annular loading body is inserted into the upset portion of the head. When this occurs, the compliant tube is plastically deformed and thereby forms a seal between the upset portion and the generally coaxial center conductor. The benefit of pre-compressing the seal to a desired pressure is that any fluid pressurized to less than the pre-compressed pressure rating will not be able to penetrate the seal. This in general shows how the seal components are assembled in conjunction with the inductive transformer and coaxial connector. The advantages of these features will be explained in the discussion below and shown in the remaining drawings.

Figure 8:
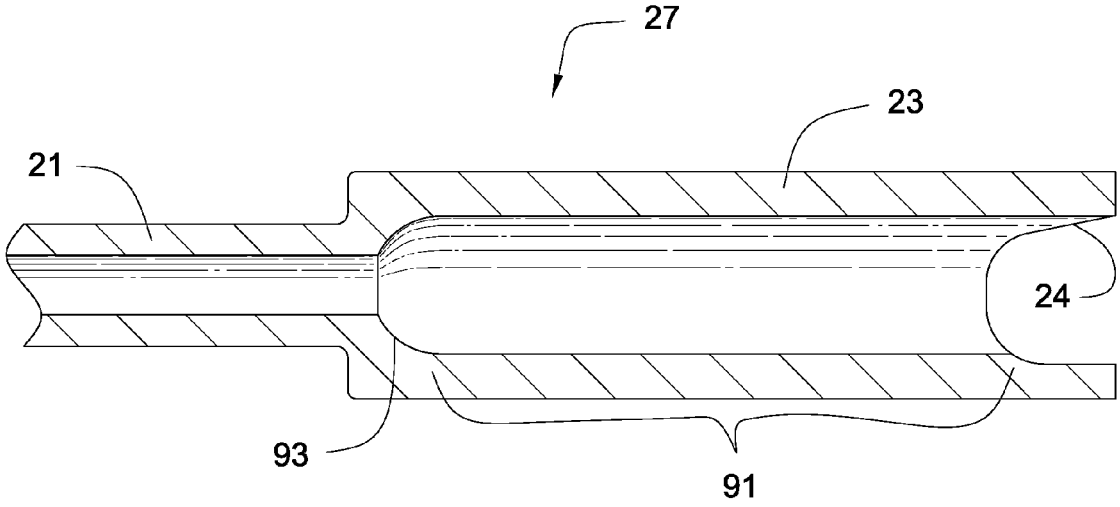
FIG. 8 is a cross sectional side view of the head of the coaxial cable connector as shown in FIG. 5 but without the sealing components.
Figure 9:
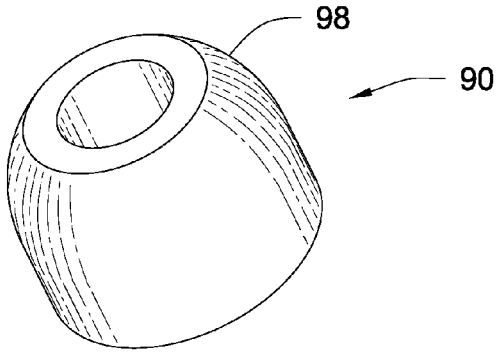
FIG. 9 is a perspective view of the first bead of the invention.

FIG. 8 shows a cross sectional side view of the head of the coaxial cable connector as shown in FIG. 9. The head 23 is at the first end 27 of the tube 21 with a saddle 24 and an upset portion 91 formed within the head 23. The upset portion 91 includes a specially contoured bottom 93 fashioned to mate with the bottom contour of the first bead (not shown) of the seal.

FIGS. 9 through 13 depict the seal components and their various features and embodiments of the current invention. Beginning with FIG. 9, we see a perspective view of the first bead in its most preferred embodiment. An end 98 of the bead is specially fashioned to substantially mate with the bottom contour of the upset portion within the coaxial cable connector. In the most preferred embodiment, the end has a tapered rounded edge. Other embodiments of the first bead could employ various shapes of the mating end of the bead to substantially conform to the bottom contour of of the upset portion.

The first bead is preferably constructed of a hard material to withstand the pressure load of the compliant tube and the second packing bead. Some examples of desirable materials are ceramics, metals, and rigid plastics. The ceramics include cemented tungsten carbide, alumina, silicon carbide, silicone nitride and polycrystalline diamond wich alumina the most preferred material. Various types of steels including viscount 44, D2, stainless steels, tool steel, and 4100 series steels are also appropriate to use. Some other examples of metals are titanium, chrome, nickel aluminum, iron, copper, tin, and lead. Two preferred types of rigid plastics available out of which to construct the first are polyether ether ketones and its cousin polyether ketone ketones, including the metal, glass, and mineral filled grades of these materials.

Figure 10:
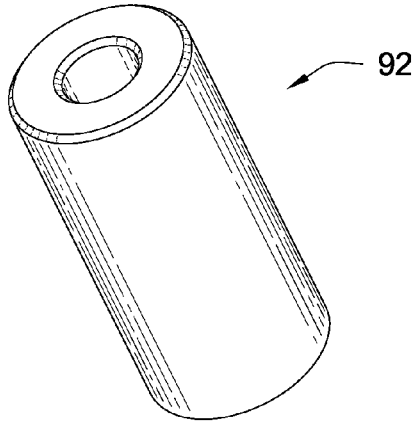
FIG. 10 is a perspective view of the compliant tube of the current invention.

FIG. 10 shows a perspective view of the compliant tube 92. It is desirable for the internal diameter of the tube to be smaller than the outer diameter of the coaxial center conductor. This feature ensures that the compliant tube is pressed against the center conductor even prior to pre-compressing the tube and the second packing bead upon insertion of the annular loading body, thereby further ensuring energized engagement of the compliant tube and conductor surfaces enhancing the sealability. The compliant tube should be constructed out of a material that will plastically deform under a load. The various types and grades of Teflons are the preferred materials out of which to make the tube.

Figure 11:
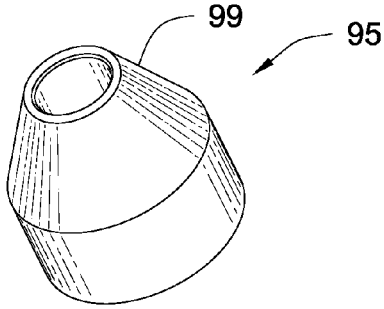
FIG. 11 is a perspective view of an embodiment of the second packing bead of the invention.
Figure 12:
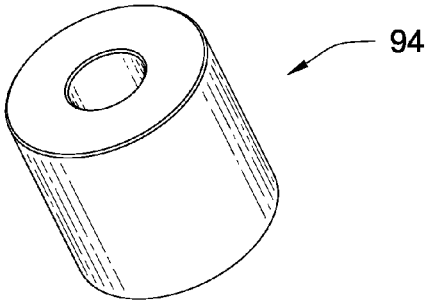
FIG. 12 is a perspective view of another embodiment of the second packing bead of the present invention.

FIGS. 11 and 12 show two embodiments of the second packing bead. In the first embodiment, a packing bead 95 has truncated tapered edge 99. In this embodiment, the tapered edge is placed adjacent the annular loading body so that the loading body engages the tapered edge during assembly of the seal. FIG. 12 shows a generally cylindrical packing bead 94. The second packing bead can be made of pyrophyllite, which upon compression forms a gasket. Rigid plastics such as polyether ether ketones and polyether ketone ketones, including the glass, mineral and metal filled grades, can also be used to manufacture the second packing bead.

Figure 13:
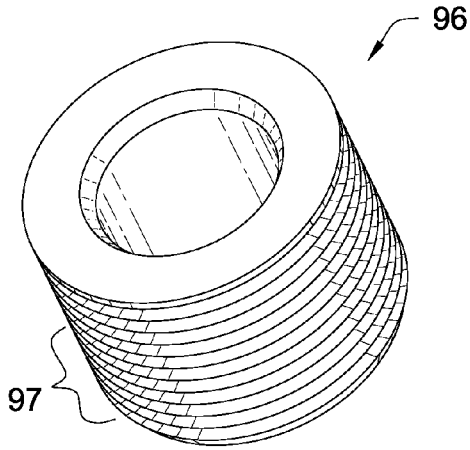
FIG. 13 is a perspective view of an embodiment of the annular loading body including circumferential barbs.

FIG. 13 shows a perspective view of the annular loading body 96. The annular loading body in this depicted embodiment includes external circumferential barbs for mechanically engaging the upset portion of the coaxial cable connector. Other means to engage the upset portion could also be employed. The annular loading body can be constructed of metals such as steel, titanium, chrome, nickel, aluminum, iron, copper, tin, and lead. Various types of steels available are viscount 44, D2, stainless steel, tool steel, and 4100 series steels with viscount 44 the most preferred.

Many types of data sources are important to management of a drilling operation. These include parameters such as hole temperature and pressure, salinity and pH of the drilling mud, magnetic declination and horizontal declination of the bottom-hole assembly, seismic look-ahead information about the surrounding formation, electrical resistivity of the formation, pore pressure of the formation, gamma ray characterization of the formation, and so forth. The high data rate provided by the present invention provides the opportunity for better use of this type of data and for the development of gathering and use of other types of data not presently available.

Whereas the present invention has been described in particular relation to the drawings attached hereto, it should be understood that other and further modifications apart from those shown or suggested herein, may be made within the scope and spirit of the present invention.

It is therefore intended that the foregoing detailed description be regarded as illustrative rather than limiting, and that it be understood that it is the following claims, including all equivalents, that are intended to define the spirit and scope of this invention.

What is claimed is:

1. A seal for a coaxial cable connector:

the coaxial cable connector comprising a tube with an upset portion at an end of the tube and a generally coaxial center conductor, the coaxial center conductor passing through the tube and the seal;

the seal contained within the upset portion of the tube, the seal comprising:

a first bead disposed within the upset portion;

a compliant tube having one end adjacent to the bead;

a second, packing bead adjacent to the other end of the compliant tube;

an annular loading body adapted to engage the upset portion and adjacent the second packing bead;

wherein, upon insertion, the annular loading body compressing the second packing bead and the compliant tube between the loading body and the first bead such that the compliant tube plastically deforms and seals against the upset portion and the coaxial center conductor wherein the first bead has a tapered rounded edge to mate with a contour of the upset portion bottom.

2. The seal for a coaxial cable connector of claim 1, wherein the seal is pre-compressed to 25,000 psi.

3. The seal for a coaxial cable connector of claim 1 wherein the bead is constructed of ceramic.

4. The seal for a coaxial cable connector of claim 3 wherein the ceramic is selected from the group consisting of cemented tungsten carbide, alumina, silicon carbide, silicone nitride, and polycrystalline diamond.

5. The seal for a coaxial cable connector of claim 1 wherein the bead is constructed of metal.

6. The seal for a coaxial cable connector of claim 5 wherein the metal is selected from the group consisting of steel, titanium, chrome, nickel, aluminum, iron, copper, tin, and lead.

7. The seal for a coaxial cable connector of claim 6 wherein the steel is selected from the group consisting of viscount 44, D2, stainless steel, tool steel, and 4100 series steels.

8. The seal for a coaxial cable connector of claim 1 wherein the bead is constructed of a rigid plastic material.

9. The seal for a coaxial cable connector of claim 8 wherein the plastic material is selected from the group consisting of polyether ether ketones and polyether ketone ketones.

10. The seal for a coaxial cable connector of claim 1 wherein the compliant tube is made of Teflon.

11. The seal for a coaxial cable connector of claim 1 wherein an internal diameter of the compliant tube is smaller than an outer diameter of the coaxial center conductor.

12. The seal for a coaxial cable connector of claim 1 wherein the packing bead has a truncated tapered edge.

13. The seal for a coaxial cable connector of claim 1 wherein the packing bead is constructed of pyrophyllite.

14. The seal for a coaxial cable connector of claim 1 wherein the packing bead is constructed of polyether ether ketone and polyether ketone ketone.

15. The seal for a coaxial cable connector of claim 1 wherein the annular loading body has external circumferential barbs.

16. The seal for a coaxial cable connector of claim 1 wherein the annular loading body is constructed of is metal.

17. The seal for a coaxial cable connector of claim 15 wherein the metal is selected from the group consisting of steel, titanium, chrome, nickel, aluminum, iron, copper, tin, and lead.

18. The seal for a coaxial cable connector of claim 16 wherein the steel is selected from the group consisting of viscount 44, D2, stainless steel, tool steel, and 4100 series steels.

* * * * *